US006085625A

United States Patent [19]

Sandford

[11] Patent Number: 6,085,625

[45] Date of Patent: Jul. 11, 2000

[54] STEEL RULE DIE SYSTEM

[76] Inventor: Peter E. Sandford, 176 Stronach Crescent, London, Ontario, Canada, N5V 3A1

[21] Appl. No.: 09/122,659

[22] Filed: Jul. 27, 1998

Related U.S. Application Data

[60] Provisional application No. 60/053,979, Jul. 28, 1997.

[51] Int. Cl.[7] ..... B26D 7/00

[52] U.S. Cl. ..... 83/698.31; 83/698.11; 76/107.8

[58] Field of Search ..... 83/698.11, 698.31, 83/699.11; 76/107.4, 107.8

[56] References Cited

U.S. PATENT DOCUMENTS

| | | | |
|---|---|---|---|
| Re. 35,522 | 6/1997 | Holliday | 83/698.31 |
| 3,835,746 | 9/1974 | Young, Jr. et al. | 83/346 |
| 3,941,038 | 3/1976 | Bishop | 93/58.4 |
| 4,052,886 | 10/1977 | Buick | 93/58.3 |
| 5,029,505 | 7/1991 | Holliday | 83/652 |
| 5,140,872 | 8/1992 | Holliday et al. | 76/107.8 |
| 5,143,768 | 9/1992 | Wilderman et al. | 76/107.8 X |
| 5,197,367 | 3/1993 | Holliday | 83/698 |
| 5,211,084 | 5/1993 | Holliday et al. | 76/107.8 |
| 5,275,076 | 1/1994 | Greenwalt | 83/698 |
| 5,333,519 | 8/1994 | Holliday et al. | 76/107.8 |
| 5,515,749 | 5/1996 | Sandford | 76/107.8 X |
| 5,566,594 | 10/1996 | Michlin | 76/107.8 |

*Primary Examiner*—Rinaldi I. Rada
*Assistant Examiner*—T. Anthony Vaughn
*Attorney, Agent, or Firm*—Martin Marcus

[57] ABSTRACT

A novel steel rule die system is provided herein. Such system includes an upper, dimensionally-stable plate (e.g., of steel) which has been laser cut in a series of primary main kerfs. It also includes an intermediate plate of a synthetic plastic material having the property of elastic deformability, e.g., LEXAN™, or LUCITE™. The intermediate plate has been laser cut in a series of secondary main kerfs, those secondary main kerfs being originally identical to the series of primary main kerfs, but, in addition, including, in at least one, and preferably in each, of the secondary main kerfs, at least one region which includes an interference kerf. The interference kerf is laterally-offset from a longitudinally-extending axis of the secondary main kerf, and is of substantially the same width as the secondary main kerf and is in direct communication with the secondary main kerf. The intermediate plate also includes a relief kerf, the relief kerf being disposed alongside the interference kerf, and being spaced a predetermined distance from the closer outer edge of the secondary main kerf. A particularly specified structural relationship exists between the relief kerf, the secondary main kerf and the interference kerf, namely the offset-distance between the interference kerf and the secondary main kerf has been specified. It finally includes a lower, dimensionally-stable plate (e.g., of steel) which has been laser cut in a series of tertiary main kerfs which is identical to the series of primary main kerfs. A plurality of steel rules is disposed within the series of primary main kerfs and within the series of tertiary main kerfs and is selectively-releasably-secured within the series of secondary main kerfs. Finally, means are provided which rigidly secure the upper, dimensionally-stable plate, the intermediate synthetic plastic plate and the lower dimensionally-stable plate together in a dimensionally-stable manner, thereby to provide a monolithic steel rule die system unit.

20 Claims, 7 Drawing Sheets

24
26
30

26
24
30

26
24
30

30
26
24
30
26
24

26
30
24
30
26
24

24
26
30
26
24
30

26
30
24
24
26
30

STEEL RULE DIE SYSTEM

RELATED INVENTION

This application is a continuation-in-part of application U.S. Ser. No. 60/053,979, filed Jul. 28, 1997, the entire contents of which are herein incorporated by reference.

BACKGROUND OF THE INVENTION (a) Technical Field of the Invention

The present invention relates generally to steel rule dies.

(b) Description of the Prior Art

Steel rule dies are widely used to cut a variety of materials, e.g., cardboard and plastics, into a desired shape. Often, to form the steel rule dies, the steel rules were pressure inserted into slots which were located in a board of wood or other suitable material. During operation of the cutter, these steel rules often became loosened and ultimately disengaged, thereby necessitating costly and time consuming interruption of the cutting process as repairs were undertaken.

Several attempts have been made to prevent this loosening of the steel rules in such steel rule dies. For example, U.S. Pat. No. 3,835,746, patented Sep. 17, 1974 by W. O. Young, Jr. et. al., provided a steel rule die in which the steel rule was inserted in a slot with its flat underside in direct contact with a backing plate. Removable resilient mounting means applied a spring force against the steel rule to hold the steel rule against a rigid support in the proper position. Removability of the resilient mounting means permitted ready replacement of any damaged steel rule. The resilient support had a spring which was secured thereto and which extended outwardly therefrom. The combined spring system was deformed by the steel rule upon insertion of the steel rule from above and continually applied a spring force against the steel rule to hold the steel in place. However, such deformation often led to mechanical failure of the retaining system as the steel rules were continuously replaced.

U.S. Pat. No. 3,941,038, patented Mar. 2, 1976, by T. D. Bishop, disclosed a die cutting apparatus in which a cutting steel rule was supported in slots in a relatively massive support plate by using sinuous resilient elements and shims lying between walls of the slots in the support plate and the sides of the steel rule. This apparatus necessitated a difficult insertion of the steel rule between the resilient member and shims.

U.S. Pat. No. 4,052,886, patented Oct. 11, 1977, by J. A. Buick, disclosed a cutting and scoring die which included a solid base material that was cavernous and was slotted for steel rule protrusion through the top surface thereof. The steel rule was anchored to the base material by the use of a semi-rigid filler material. However, this method required time-consuming filling, and the ultimate strength of securing was dependant on the filler material which was selected. In addition, the steel rules could not easily be replaced should one steel rule be broken or otherwise disabled.

U.S. Pat. No. 5,029,505, patented Jul. 9, 1991, by K. Holliday, disclosed an apparatus for retention of steel rules which were inserted into slots of a retaining board of a steel rule die. A plurality of chambers was oriented substantially-perpendicularly to the direction of insertion and had open faces to permit communication with the slots. A spring was located within each chamber and was connected to a ball-shaped member which was located at the open face. Upon insertion of the steel rule, the ball-shaped member caused the spring to compress. Once the steel rule was completely inserted, the ball/spring assembly exerted a normal force against the steel rule in the direction of the slot wall which was opposite to the open face. Accordingly, the inserted steel rule was said to be securely held within the slots. However, the apparatus was complex, expensive to manufacture, and required large chambers to be cut into the retaining board, and thereby restricted its use depending on the providing of adequate spaces between the steel rules, i.e., on the geometry of the steel rule die. Manufacturing of the spring and ball assembly inside the housing was also a complicated task.

U.S. Pat. No. Re. 35,522, patented Jun. 3, 1997, by K. Holliday, provided an apparatus for retention of steel rules which were inserted into die slots of a retaining board. A plurality of lock slots was oriented substantially-perpendicularly to the direction of insertion and had open faces to permit communication with the die slots. A kerf lock was located within each lock slot and extended into the die slot until a steel rule was inserted into the die slot. Upon initial insertion of a steel rule into the die slot, the kerf lock compressed. Once the steel rule was completely inserted, the kerf lock exerted a normal force against the steel rule in the direction of the die slot wall opposite to the open face. An inserted steel rule was thus said to be securely held within the die slot.

SUMMARY OF THE INVENTION (a) Aims of the Invention

However, all these prior art patents suffered the deficiency that they required an additional element or elements to be inserted in the retaining board.

Accordingly, it is one object of the present invention to provide a system in which steel rules are securely, but selectively-removably-retained, in a retaining board without the need for the use of additional components.

It is a further object of the present invention to provide such a system which enables easy insertion, and easy selective removal, of a steel rule into, and out of, the die slot.

It is a still further object of the present invention to provide a simple and economical steel rule die system which is durable and long lasting.

(b) Statement of Invention

The present invention provides a steel rule die comprising (a) an upper, dimensionally-stable plate which has been laser cut in a series of primary main kerfs; (b) an intermediate plate of a synthetic plastic material having the property of elastic deformability, the intermediate plate having been laser cut in a series of secondary main kerfs, the series of secondary main kerfs being originally identical to the series of primary main kerfs, but, in addition, including, in each of the series of secondary main kerfs, at least one region which includes an interference kerf, the interference kerf being of the same width as the secondary main kerf, but being laterally-offset from a longitudinally-extending axis of the secondary main kerf, and being in direct communication with the secondary main kerf, the intermediate plate also including a relief kerf, the relief kerf being disposed alongside the interference kerf, and being spaced a predetermined distance from the closer outer edge of the secondary main kerf, the laterally-offset distance between the interference kerf and the secondary main kerf being substantially equal to the width of the secondary main kerf, the length of the relief kerf being substantially equal to, but slightly longer than, the length of the interference kerf; (c) a lower, dimensionally-stable plate which has been laser cut in a series of tertiary main kerfs which is identical to the series of primary main kerfs; (d) a plurality of steel rules each of which extend downwardly through an associated one of the series of primary main kerfs and each of which extend downwardly through, and are selectively-releasably-secured within an associated one of the series of secondary main kerfs in the intermediate plate and extend into, and repose within, an associated one of the series of tertiary main kerfs in the lower plate; and (e) means rigidly securing the upper, dimensionally-stable plate, the intermediate synthetic plastic plate and the lower dimensionally-stable plate together in a dimensionally-stable manner, thereby to provide a monolithic unit.

The present invention also provides a steel rule die comprising (a) an upper steel plate which has been laser cut in a series of primary main kerfs; (b) an intermediate plate of a synthetic plastic material having the property of elastic deformability, the intermediate plate having been laser cut in a series of secondary main kerfs, the series of secondary main kerfs being originally identical to the series of primary main kerfs, but, in addition, including, in each of the secondary main kerfs, at least one region which includes an interference kerf, the interference kerf being laterally-offset from a longitudinally-extending axis of the secondary main kerf, and being of the same width as the secondary main kerf and being in direct communication with the secondary main kerf, the intermediate plate also including a relief kerf, the relief kerf being disposed alongside the interference kerf, and being spaced a predetermined distance from the closer outer edge of a secondary main kerf, the laterally-offset distance between the interference kerf and the secondary main kerf being substantially equal to the width of the secondary main kerf, the length of the relief kerf being substantially equal to, but slightly longer than, the length of the interference kerf; (c) a lower steel plate which has been laser cut in a series of tertiary main kerfs which is identical to the series of primary main kerfs; (d) a plurality of steel rules each of which extend downwardly through an associated one of the series of primary main kerfs and which extend downwardly through, and are selectively-releasably-secured within an associated one of the series of secondary main kerfs in the intermediate plate and extend into, and repose within, an associated one of the series of tertiary main kerfs in the lower plate; and (e) means rigidly securing the upper steel plate, the intermediate plate of synthetic plastic material and the lower steel plate together in a dimensionally-stable manner, thereby to provide a monolithic unit.

The present invention still further provides a steel rule die comprising: (a) an upper steel plate which has been laser cut in a series of primary main kerfs; (b) an intermediate plate which is formed of a thermoplastic, carbonate-linked polymer which has the property of elastic deformability, the intermediate plate having been laser cut in a series of secondary main kerfs, the series of secondary main kerfs being originally identical to the series of primary main kerfs, but, in addition, including, in at least one of the secondary main kerfs, at least one region which includes an interference kerf, the interference kerf being of substantially the same width as the secondary main kerf but being laterally-offset from a longitudinally-extending axis of the secondary main kerf, and being in direct communication with the secondary main kerf, the intermediate plate also including a relief kerf, the laterally-offset distance between the interference kerf and the secondary main kerf being substantially equal to the width of the secondary main kerf, the length of the relief kerf being substantially equal to, but slightly longer than, the length of the interference kerf, the relief kerf being disposed alongside the interference kerf, and being spaced a predetermined distance from the closer outer edge of the secondary main kerf wherein each primary main kerf is linear, whereby each corresponding tertiary main kerf is likewise linear, and wherein each corresponding secondary main kerf and each corresponding interference kerf each are likewise linear, and wherein the associated relief kerf is linear; (c) a lower steel plate which has been laser cut in a series of tertiary main kerfs which is identical to the series of primary main kerfs; (d) a peripheral steel band encasing peripheral edges of the intermediate plastic plate, the steel band being sandwiched between perimetral edges of the upper plate and the lower plate; (e) a plurality of steel rules each of which extend downwardly through an associated one of the series of primary main kerfs and each of which extend downwardly through, and are selectively-releasably-secured within an associated one of the series of secondary main kerfs in the intermediate plate and extend into, and repose within, an associated one of the series of tertiary main kerfs in the lower plate; and (f) means rigidly securing the upper steel plate, the intermediate plate of synthetic plastic material and the lower steel plate together in a dimensionally-stable manner, thereby to provide a monolithic unit, the means rigidly securing solid upper plate, the intermediate plate and the lower plate together in a dimensionally-stable manner including a nut and bolt combination passing through aligned apertures in the four corners of each the plates.

(c) Other Features of the Invention

By one feature of this invention, the steel rule die includes a peripheral band, preferably of steel, encasing the peripheral edges of the intermediate synthetic plate, and preferably sandwiched between perimetral edges of the lower face of the upper plate and the upper face of the lower plate.

By alternative features of this invention, and of the above one feature of the invention, the intermediate synthetic plastic plate is formed of a thermoplastic, carbonate-linked polymer, or is formed of a polymeric ester of methacrylic acid.

By yet other alternative features of this invention, and of the above features of the invention, at least one main kerf in the series of primary main kerfs, and preferably each main kerf in the series of primary main kerfs is linear, whereby a corresponding main kerf or main kerfs in the series of tertiary main kerfs is likewise linear, and a corresponding main kerf or main kerfs and a corresponding interference kerf or interference kerfs in the series of secondary main kerfs is likewise linear, and an associated relief kerf is linear.

By still another alternative feature of this invention, and of the above features of the invention, at least one main kerf in the series of primary main kerfs is arcuate, whereby a corresponding main kerf in the series of tertiary main kerfs is likewise arcuate, and a corresponding main kerf and a corresponding interference kerf in the series of secondary main kerfs is arcuate, and an associated relief kerf is arcuate.

By yet another alternative feature of this invention, and of the above features of the invention, at least one main kerf in the series of primary main kerfs, and preferably each main kerf in the series of primary main kerfs, is linear, whereby a corresponding main kerf or main kerf in the series of tertiary main kerfs is likewise linear, and a corresponding main kerf or main kerfs and a corresponding interference kerf or interference kerfs in the series of secondary main kerfs is likewise linear, and an associated relief kerf is arcuate.

By still another alternative feature of this invention, and of the above features of the invention, at least one main kerf in the series of primary main kerfs is arcuate, whereby a corresponding main kerf in the series of tertiary main kerfs is likewise arcuate, and a corresponding main kerf and a corresponding interference kerf in the series of secondary main kerfs is likewise arcuate, and an associated relief kerf are linear.

By yet a further feature of this invention, and of the above features of the invention, the means rigidly securing solid upper plate, the intermediate plate and the lower plate together in a dimensionally-stable manner includes a nut and bolt combination passing through aligned apertures in the four corners of each the plates. By a specific feature of this feature, the steel rule die includes a plurality of set screws which are secured within aligned apertures adjacent to the primary, secondary and tertiary kerfs, to enhance the dimensional stability of the intermediate synthetic plastic plate.

By still yet a further feature of this invention, and of the above features of the invention, at least one main kerf in the series of secondary main kerfs is provided with a pair of opposed interference kerfs, and with a pair of associated opposed relief kerfs By still yet a further feature of this invention, and of the above features of the invention, at least one relief kerf is fitted with an insert of a natural or synthetic rubbery material. By a specific feature of this feature, the natural or synthetic rubbery material is a polyurethane rubber.

(d) Generalized Features of the Invention

It is essential for this invention to have the secondary main kerfs, the interference kerfs and the relief kerfs in the intermediate, synthetic plastic plate. The interference kerf is offset laterally from the central longitudinal axis of the secondary main kerf, and is in direct communication with such secondary main kerf in the retaining board, i.e., the intermediate synthetic plastic plate. Described another way, the interference kerf is generally in the form of a temporary lateral deviation of the path of the secondary main kerf. The relief kerf is disposed closely adjacent to, but not in communication with, the closer edge of the secondary main kerf. The laterally-offset distance between the interference kerf and the secondary main kerf is substantially equal to the width of the second main kerf. The length of the relief kerf is substantially equal to, but is slightly longer than, the length of the interference kerf. Insertion of the steel rule into the secondary main kerf in the intermediate synthetic plastic plate causes a deformation of the laterally-offset interference kerf. Such deformation of the interference kerf thereby causes a resilient gripping of the steel rule. Any stresses which are built up in the synthetic plastics material of the intermediate synthetic plastic plate by the deformation of the interference kerf are absorbed by a corresponding deformation of the relief kerf, thereby essentially preventing fracturing of the synthetic plastics material of the intermediate synthetic plastic plate, and the setting up of any fatigue in the synthetic plastic material.

The holding power of the secondary main kerfs in the synthetic plastic material plate may be varied by changing the extent of the length of the interference kerf, and/or by changing the extent of the lateral off-set of the interference kerf, and/or by changing the length of the relief kerf, and/or by changing the distance between the secondary main kerf and the relief kerf.

DESCRIPTION OF PREFERRED EMBODIMENTS (a) Description of FIG. 1, FIG. 2, FIG. 3 and FIG. 4

Figure 1:
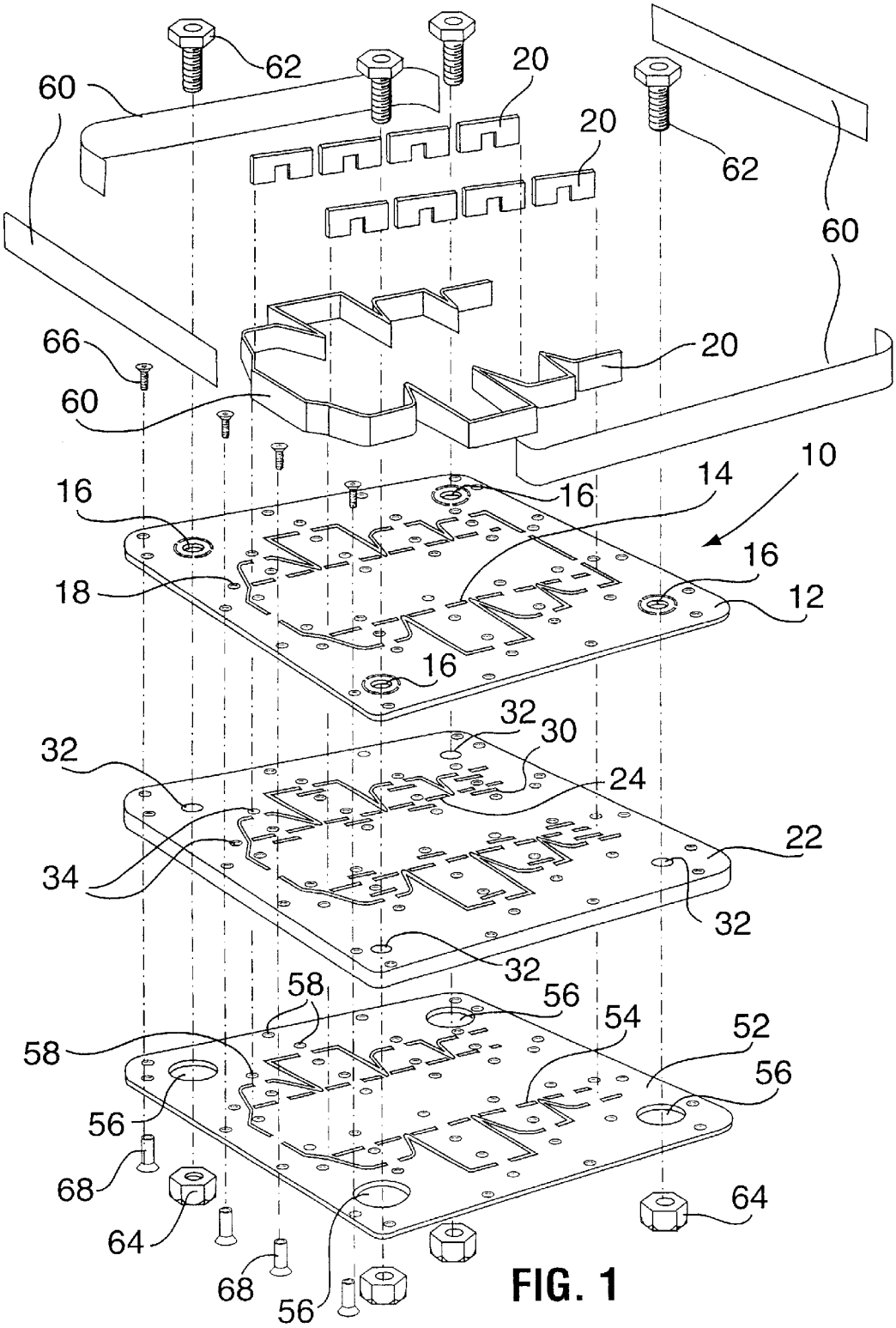
FIG. 1 is an exploded perspective view of the steel rule die of this invention.
Figure 2:
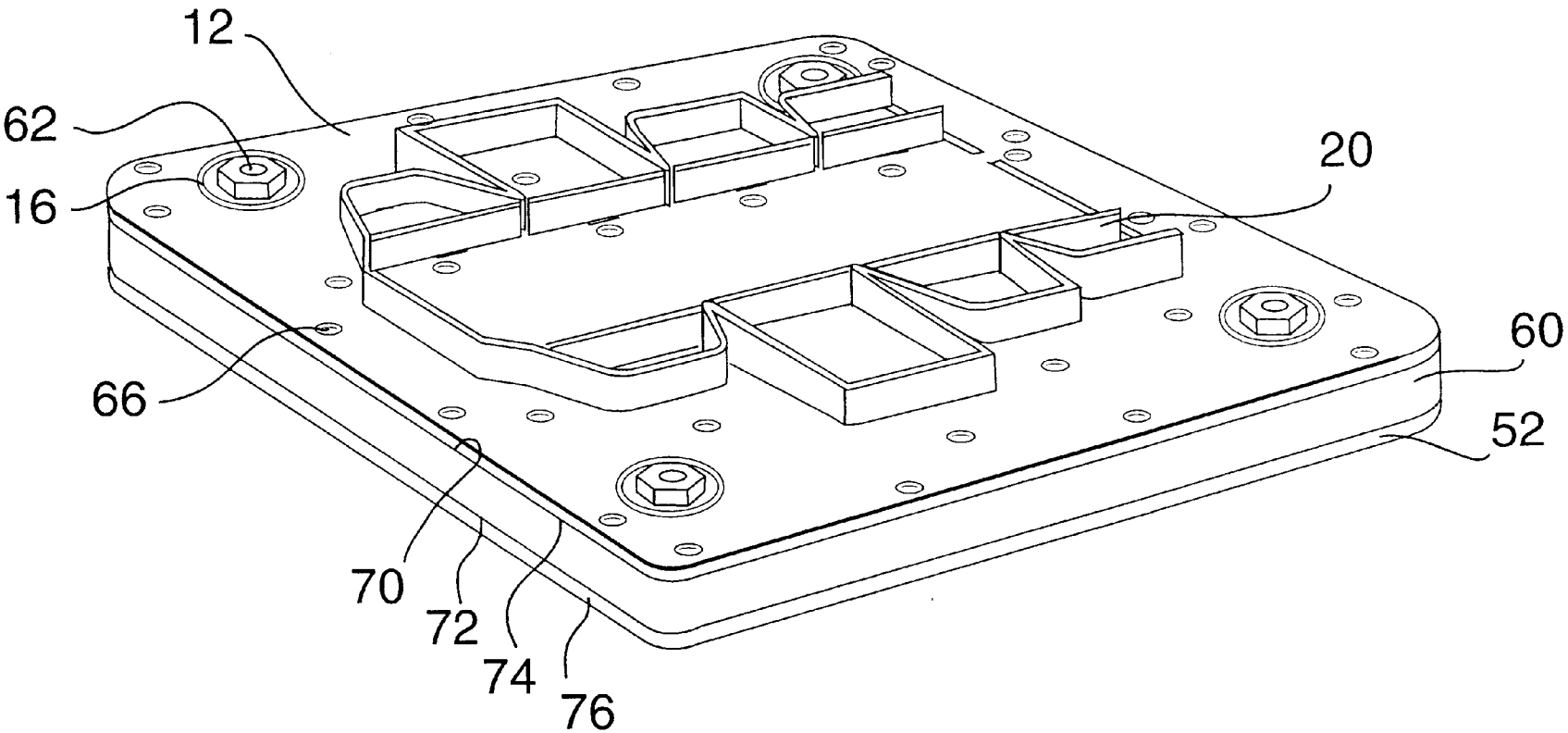
FIG. 2 is a perspective top view of the steel rule die of this invention.
Figure 3:
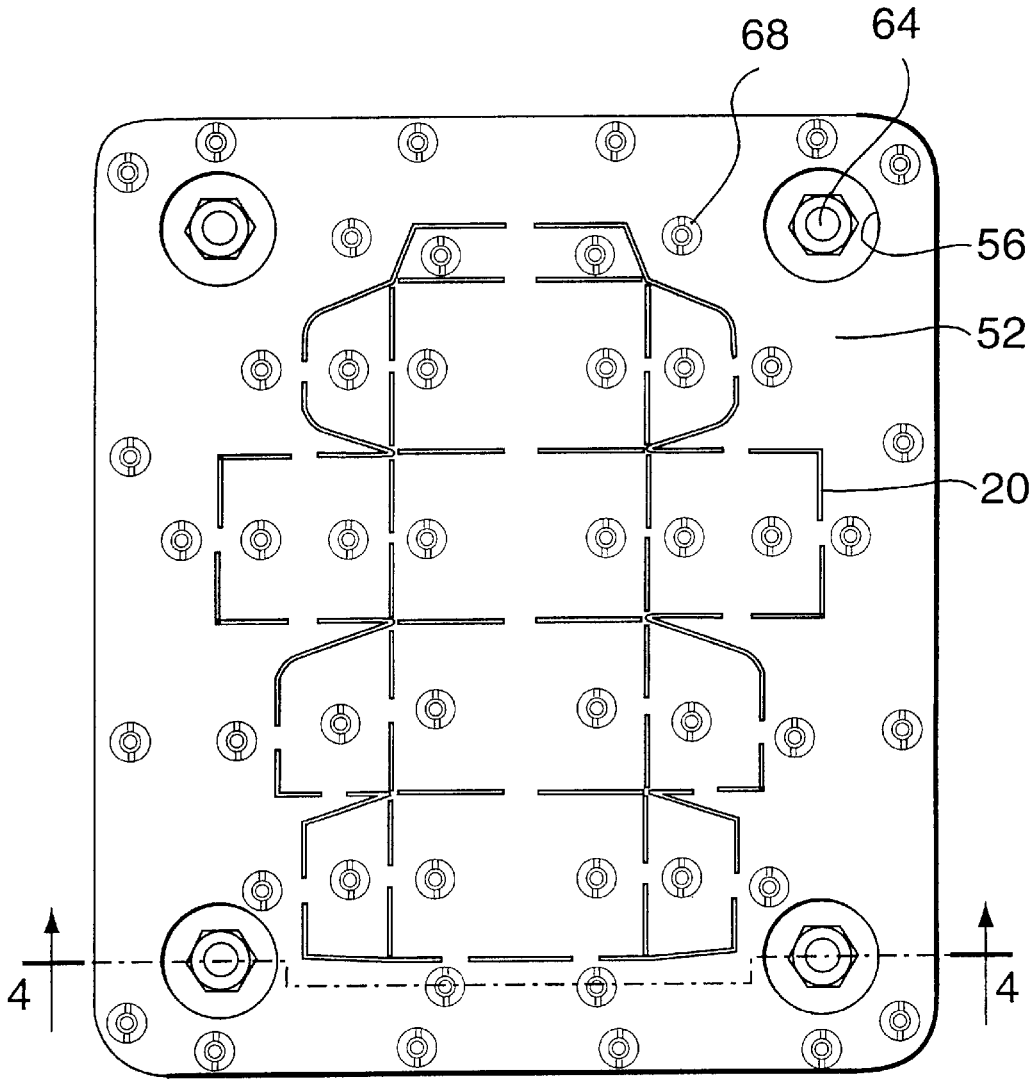
FIG. 3 is a perspective bottom view of the steel rule die of this invention.
Figure 4:
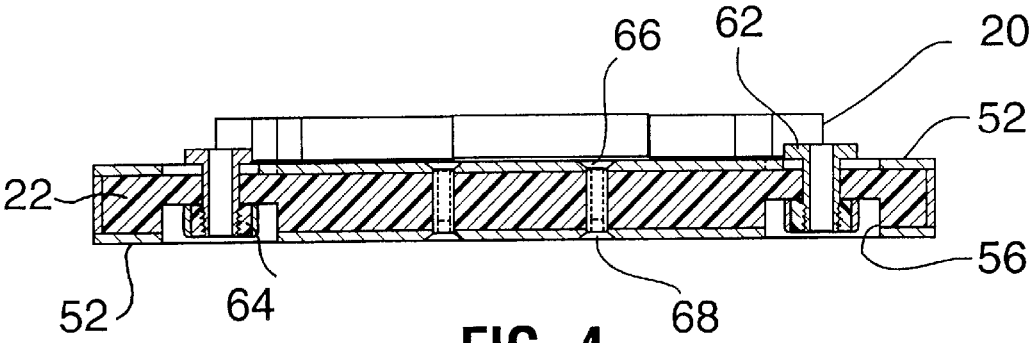
FIG. 4 is a cross-section along line IV—IV of FIG. 2.
Figure 5A:
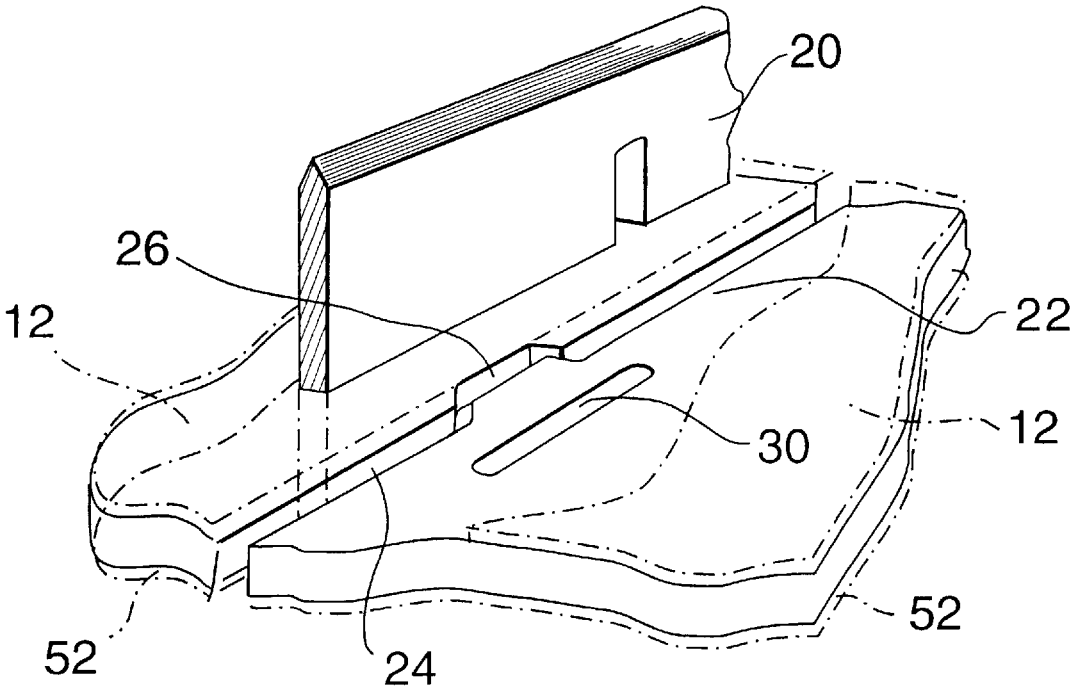
FIG. 5A is a schematic, enlarged, perspective "before" view.
Figure 5B:
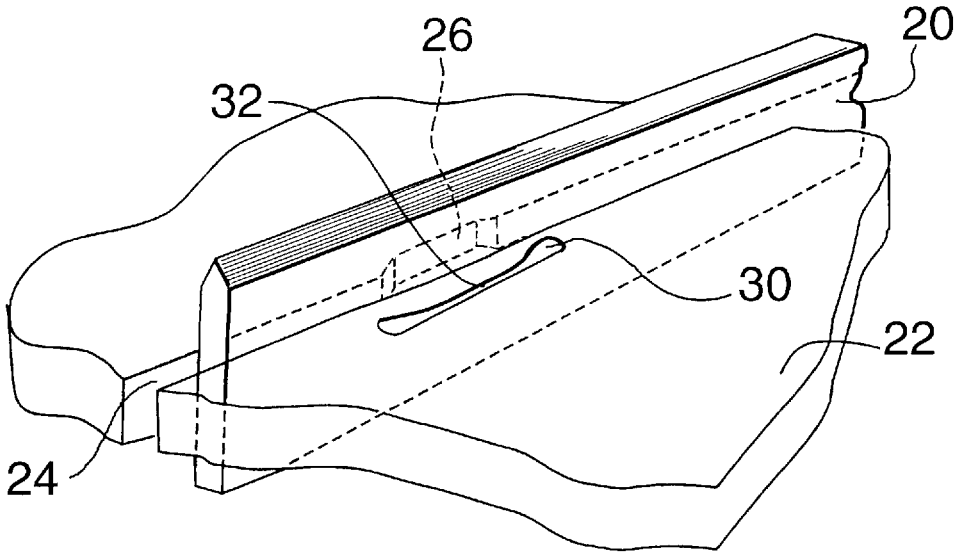
FIG. 5B is a schematic, enlarged, perspective "after" view of the insertion of a steel rule into a secondary main kerf.
Figure 6A:
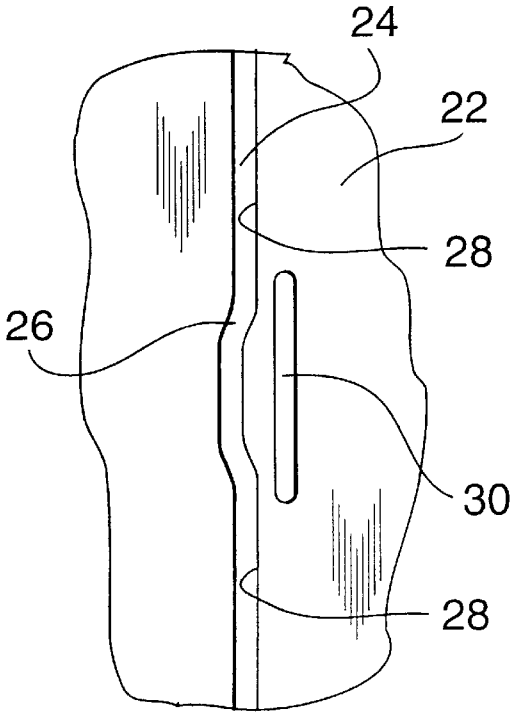
FIG. 6A is a schematic, enlarged top "before" view.
Figure 6B:
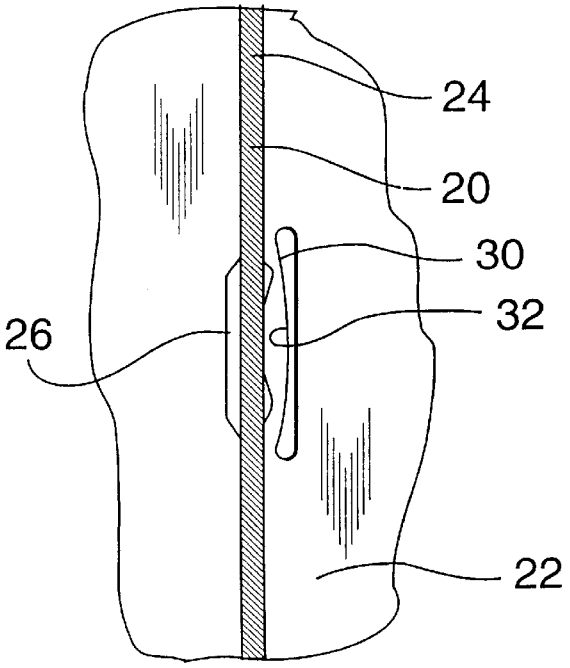
FIG. 6B is a schematic, enlarged top "after" view of the insertion of a steel rule into a secondary main kerf.

As seen in the exploded view of FIG. 1, and in the views of FIG. 2 to FIG. 4, the steel rule die 10 comprises an upper, dimensionally-stable, plate 12, preferably of steel having a thickness of about 1/16" to about 1/8". The plate 12 is provided with a series of primary main kerfs 14, whose outline is determined by the shape of the carton whose blank it is desired to cut on an automatic die-cutting machine. The primary main kerfs 12 have a typical width of about 0.028", or more or less. Fitted within the main kerf 14 is a set of steel rules 20. The plate 12 is provided with an aperture 16 at each corner thereof, whose purpose will be described hereinafter. The plate 12 is also provided with a plurality of smaller apertures 18, which are disposed closely adjacent to the series of primary main kerfs 14, and whose purpose will be described hereinafter.

The steel rule die 10 also includes an intermediate plate 22 of a synthetic plastics material, which has the property of elastic deformability. Plate 22, which may have a thickness of about 5/8" to about 1/8", may be constituted by a material known by the trademark LEXAN™, or by the trademark LUCIT™. (LEXAN™ is a registered trademark for a thermoplastic carbonate-linked polymer which is produced by reacting bisphenol A with phosgene. LUCIT™ is a registered trademark for polymeric esters of methacrylic acid). The plate 22 is provided with a series of secondary main kerfs 24 whose shape and width is initially identical to the shape and width of the series of primary main kerfs 14 of plate 12.

Plate 22 is also provided with an interference kerf 26 which is essentially a laterally-offset kerf which is in direct communication with the secondary main kerf 24. (See FIGS. 5A, 5B, 6A, 6B) The interference kerf 26 typically is about 0.080" to 0.125", or more or less long, and may be off-set by an amount of about 0.028" or more or less. In effect, interference kerf 26 is in the form of a temporary, lateral deviation of the path of the secondary main kerf 24. The longitudinal length and transverse off-set extent of the interference kerf 26 may be varied in order to change the holding power of the secondary main kerf 24. The holding power is herein termed the "interference factor".

Closely adjacent to, but spaced transversely from, the closer lateral edge 28 of the secondary main kerf 24 is a relief kerf 30. This relief kerf 30 is shown as a generally-rectangular (in plan view) kerf with rounded ends. The purpose of the relief kerf 30 is to absorb and counteract any stresses which are set up in the intermediate plate 22 due to the deformation of the interference kerf 26 by the insertion of the steel rule 20 into the secondary main kerf 24 of the intermediate plate 22.

The longitudinal length and width of the relief kerf 30, and the distance between the relief kerf 30 and the secondary main kerf 24, may be varied in order to change the holding power of the intermediate plate 22 for the steel rule 20. These variables of both the interference kerf and/or the relief kerf may be changed to control the "interference factor".

The intermediate plate 22 is also provided with four corner apertures 32 which are identically placed and are of the same size as the four corner apertures 16 of the upper plate 12, and a like plurality of smaller apertures 34 which are identically placed, and are of the same size as smaller apertures 18 of the upper plate.

The steel rule die 10 finally includes lower dimensionally-stable plate 52, preferably of steel, having a thickness of about 1/16" to about 1/8". This plate 52 is provided with a series of tertiary main kerfs 54 whose shape and width are identical to the shape and width of the series of primary main kerfs 14 of plate 12. Plate 52 is also provided with four corner apertures 56, whose location and size are identical to corner apertures 16 of upper plate 12, and with a like plurality of smaller apertures 58 which are identically placed, and are of the same size as smaller apertures 18 of the upper plate 12.

Surrounding the perimeter of upper plate 12, intermediate plate 22 and lower plate 52 is an encircling band, 60, e.g., of steel. (See FIG. 1, FIG. 2 and FIG. 3) The upper plate 12, intermediate plate 22 and lower plate 52 are held together by means of four corner nut and bolt combinations 62/64 passing through corner apertures 16, 32, 56. In addition, a plurality of set screws combinations 66/68 is inserted through each of the plurality of smaller apertures 18, 34, 58 to hold the upper plate 12, intermediate plate 22 and lower plate 52 together and to provide structural stability to the elastically-deformable intermediate plate 22. The encircling band 60 is held to the perimeter by having its upper and lower edges 70/72 compressed between the lower face 74 of upper plate 12 and upper face 76 of lower plate 22. In addition, the securement may be supplemented by means of a suitable adhesive. Furthermore, suitable adhesive may be placed between the upper plate, the intermediate plate and the lower plate to supplement the securement of the plates into a monolithic unit.

(b) Description of FIG. 5, FIG. 5B, FIG. 6A and FIG. 6B

FIG. 5A, FIG. 5B, FIG. 6A and FIG. 6B shows a greatly exaggerated, enlarged view of how the secondary main kerf 24, interference kerf 26 and the relief kerf 30 of the intermediate plate 22 are deformed due to the insertion of the steel rule 20 into the secondary main kerf 24 of the intermediate plate 22. It is seen that the interference kerf 26 is resiliently urged towards the relief kerf 30, and thus serves to grip the steel rule 20. Simultaneously with such resilient deformation is the setting up of stresses in the intermediate plate 22 in the region between the interference kerf 24 and the relief kerf 30. These stresses cause the relief kerf 30 in the area opposite to the interference kerf 24 to be similarly deformed or compressed to form a thinner central region, 32.

In this way, the steel rule 20 is resiliently held in the secondary main kerf 24 in the intermediate plate 22 in such a way that it may be selectively removed, and any stresses which may be set up due to such resilient deformation are absorbed and counteracted by a corresponding deformation of the relief kerf 30.

Figures 7A, 7B, 7C, 7D, 7E, 7F, 7G, 7H, 7I, 7J, 7K, 7L:
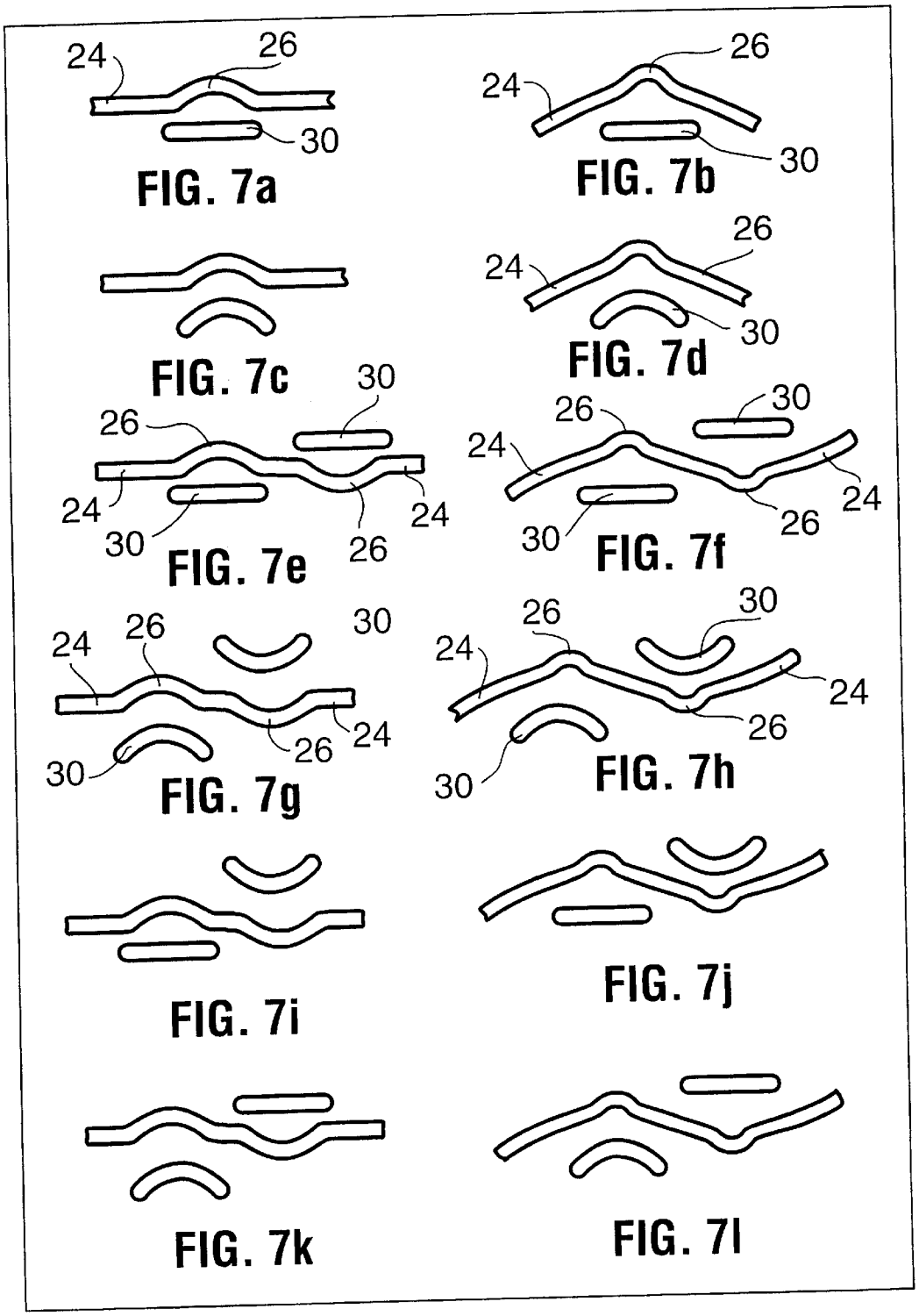
FIG. 7 is a schematic plan view of eight alternative configurations of this invention.

(c) Description of FIG. 7

FIG. 7 shows eight different combinations of main kerf/interference kerf/relief kerf, which may be represented as follows:

| BLOCK NO. | MAIN KERF | INTERFERENCE KERF | RELIEF KERF |
|---|---|---|---|
| 7a | linear | linear | linear |
| 7b | arcuate | linear | linear |
| 7c | linear | arcuate | arcuate |
| 7d | arcuate | arcuate | arcuate |
| 7e | linear | double linear | double linear |
| 7f | arcuate | double linear | double linear |
| 7g | linear | double arcuate | double arcuate |
| 7h | arcuate | double arcuate | double arcuate |
| 7i | linear | linear/arcuate | linear/arcuate |
| 7j | arcuate | linear/arcuate | arcuate/arcuate |
| 7k | linear | arcuate/linear | arcuate/linear |
| 71 | arcuate | arcuate/linear | arcuate/linear |

Figure 8:
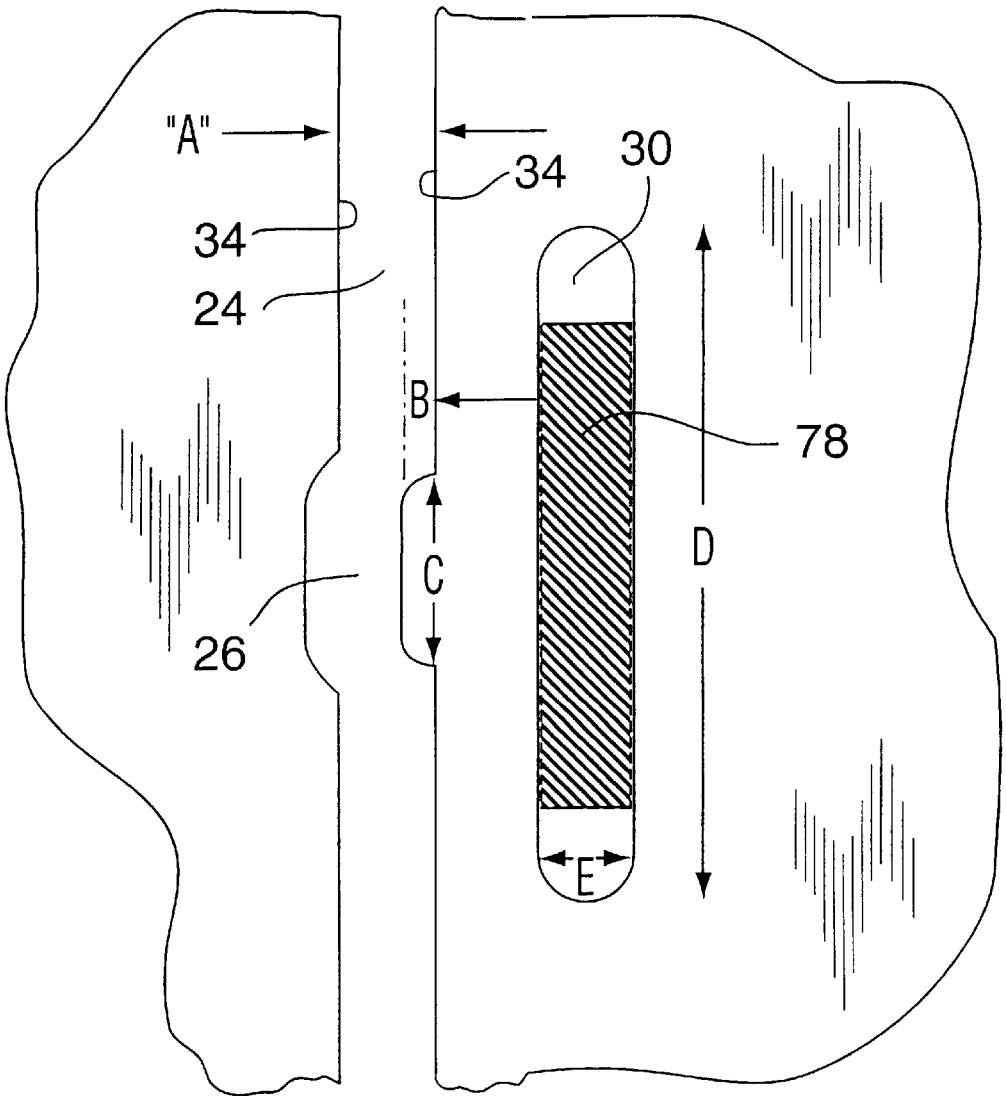
FIG. 8 is a schematic plan view explaining the theory behind this invention.

(c) Description of FIG. 8

FIG. 8 depicts, schematically, the theory behind the present invention. The secondary main kerf 24 is of a suitable width "A" and includes interference kerf 26, of the same width, but which is offset from the longitudinal edges 34 of the secondary main kerf 24 by thickness "B". These kerfs are laser cut therein. The length of interference kerf 26 is "C". The relief kerf 30 is of a length "D" and width "E" and is spaced from the leading edge 34 of secondary main kerf 24 by a distance "F".

When a steel rule 20, of thickness "A+" is inserted into secondary main kerf 24, it resiliently deforms interference kerf 26 so that distance "B" becomes zero. This then, in turn, urges the portion of relief kerf 30 in the region opposite to interference kerf 26 to be displaced to the right as shown in FIG. 8 by an amount equal to "B". Distance "F" at the extreme ends of relief kerf 30 remains the same, but the net result is a deformation of the central region 32 of relief kerf 30.

Also shown in FIG. 8, an insert 78 of a resilient material, e.g., a natural or synthetic rubber, i.e., a urethane rubber, is placed into relief kerf 30. This is to assist in the deformation of relief kerf 30 while minimizing the onset of any plastic fatigue.

CONCLUSION

The steel rule die 10 of this invention is designed to be re-ruled over and over again. Its economical construction results in cost savings. Every piece of the steel rule 20 in the secondary main kerfs 24 in the intermediate plate 22 is held tightly in place, and the length of the steel rule 20 is never too short.

The stainless steel upper plate 12 and the stainless steel lower plate 22 of the steel rule die construction 10 resist the heat and humidity problems which are normally associated with high speed cutting presses. In addition, this construction provides improved dimensional stability of the steel rule die, by the use of the corner bolt/nut combination, and by the use of the set screw constructions.

From the foregoing description, one skilled in the art can easily ascertain the essential characteristics of this invention, and without departing from the spirit and scope thereof, can make various changes and modifications of the invention to adapt it to various usages and conditions. Consequently, such changes and modifications are properly, equitably, and "intended" to be, within the full range of equivalence of the following claims.

I claim:

1. A steel rule die comprising:

(a) an upper, dimensionally-stable plate which has been laser cut in a series of primary main kerfs;

(b) an intermediate plate of a synthetic plastic material having the property of elastic deformability, said intermediate plate having been laser cut in a series of secondary main kerfs, said series of secondary main kerfs being originally identical to said series of primary main kerfs, but, in addition, including, in at least one of said secondary main kerfs, at least one region which includes an interference kerf, said interference kerf being of substantially the same width as said secondary main kerf but being laterally-offset from a longitudinally-extending axis of said secondary main kerf, and being in direct communication with said secondary main kerf, said intermediate plate also including a relief kerf, said relief kerf being disposed alongside said interference kerf, and being spaced a predetermined distance from the closer outer edge of said secondary main kerf, said laterally-offset distance between said interference kerf and said secondary main kerf being substantially equal to the width of said secondary main kerf, the length of said relief kerf being substantially equal to, but slightly longer than, the length of said interference kerf;

(c) a lower, dimensionally-stable plate which has been laser cut in a series of tertiary main kerfs which is identical to said series of primary main kerfs;

(d) a plurality of steel rules each of which extend downwardly through an associated one of said series of primary main kerfs and each of which extend downwardly through, and are selectively-releasably-secured within an associated one of said series of secondary main kerfs in said intermediate plate and extend into, and repose within, an associated one of said series of tertiary main kerfs in said lower plate; and (e) means rigidly securing said upper, dimensionally-stable plate, said intermediate synthetic plastic plate and said lower dimensionally-stable plate together in a dimensionally-stable manner, thereby to provide a monolithic unit.

2. A steel rule die comprising:

(a) an upper steel plate which has been laser cut in a series of primary main kerfs;

(b) an intermediate plate of a synthetic plastic material having the property of elastic deformability, said intermediate plate having been laser cut in a series of secondary main kerfs, said series of secondary main kerfs being originally identical to said series of primary main kerfs, but, in addition, including, in each of said secondary main kerfs, at least one region which includes an interference kerf, said interference kerf being laterally-offset from a longitudinally-extending axis of said secondary main kerf, and being in direct communication with said secondary main kerf, said intermediate plate also including a relief kerf, said relief kerf being disposed alongside said interference kerf, being spaced a predetermined distance from the closer outer edge of said secondary main kerf said laterally-offset distance between said interference kerf and said secondary main kerf being substantially equal to the width of said secondary main kerf, the length of said relief kerf being substantially equal to, but slightly longer than, the length of said interference kerf;

(c) a lower steel plate which has been laser cut in a series of tertiary main kerfs which is identical to said series of primary main kerfs;

(d) a plurality of steel rules each of which extend downwardly through an associated one of said series of primary main kerfs and which extend downwardly through, and are selectively-releasably-secured within an associated one of said series of secondary main kerfs in said intermediate plate and extend into, and repose within, an associated one of said series of tertiary main kerfs in said lower plate; and (e) means rigidly securing said upper steel plate, said intermediate plate of synthetic plastic material and said lower steel plate together in a dimensionally-stable manner, thereby to provide a monolithic unit.

3. The steel rule die as claimed in claim 1, including a peripheral band encasing the peripheral edges of said intermediate synthetic plastic plate.

4. The steel rule die as claimed in claim 2, including a peripheral steel band encasing the peripheral edges of said intermediate synthetic plastic plate, and which is sandwiched between perimetral edges of said upper plate and said lower plate.

5. The steel rule die as claimed in claim 1, wherein said intermediate synthetic plastic plate is formed of a thermoplastic, carbonate-linked polymer.

6. The steel rule die as claimed in claim 2, wherein said intermediate synthetic plastic plate is formed of a polymeric ester of methacrylic acid.

7. The steel rule die as claimed in claim 1, wherein at least one main kerf in said series of primary main kerfs is linear, whereby a corresponding tertiary main kerf is likewise linear, and wherein a corresponding secondary main kerf and a corresponding interference kerf are likewise linear, and wherein an associated said relief kerf is linear.

8. The steel rule die as claimed in claim 2, wherein each primary main kerf is linear, whereby each corresponding tertiary main kerf is likewise linear, and wherein each corresponding secondary main kerf and each corresponding interference kerf each are likewise linear, and wherein said associated relief kerf is linear.

9. The steel rule die as claimed in claim 1, wherein at least one primary main kerf is arcuate, whereby a corresponding tertiary main kerf is likewise arcuate, and wherein a corresponding secondary main kerf and a corresponding interference kerf each are likewise arcuate, and wherein said associated relief kerf is linear.

10. The steel rule die as claimed in claim 1, wherein at least one primary main kerf is linear, whereby a corresponding tertiary main kerf is likewise linear, and wherein a corresponding secondary main kerf and a corresponding interference kerf each are likewise linear, and wherein said associated relief kerf is arcuate.

11. The steel rule die as claimed in claim 2, wherein each primary main kerf is linear, whereby each corresponding tertiary main kerf is likewise linear, and wherein each corresponding secondary main kerf and each corresponding interference kerf eahc are likewise linear, and wherein said associated relief kerf is arcuate.

12. The steel rule die as claimed in claim 1, wherein at least one primary main kerf is arcuate, whereby a corresponding tertiary main kerf is likewise arcuate, and wherein a corresponding secondary main kerf and a corresponding interference kerf each are likewise arcuate, and wherein said associated relief kerf is arcuate.

13. The steel rule die as claimed in claim 2, wherein said means rigidly securing solid upper plate, said intermediate plate and said lower plate together in a dimensionally-stable manner includes a nut and bolt combination passing through aligned apertures in the four corners of each said plates.

14. The steel rule die as claimed in claim 13, including a plurality of set screws which are secured within aligned apertures adjacent said primary kerf, said secondary kerf and said tertiary kerfs, to enhance the dimensional stability of said intermediate synthetic plastic plate.

15. The steel rule die as claimed in claim 2, wherein at least one main kerf in said secondary series of main kerfs is provided with a pair of opposed interference kerfs, and with a pair of corresponding opposed relief kerfs.

16. The steel rule die as claimed in claim 2, wherein at least one said relief kerf is fitted with an insert of a natural rubber or synthetic rubbery material.

17. The steel rule die as claimed in claim 16, wherein said synthetic rubbery material is a polyurethane rubber.

18. A steel rule die comprising:

(a) an upper steel plate which has been laser cut in a series of primary main kerfs;

(b) an intermediate plate which is formed of a thermoplastic, carbonate-linked polymer which has the property of elastic deformability, said intermediate plate having been laser cut in a series of secondary main kerfs, said series of secondary main kerfs being originally identical to said series of primary main kerfs, but, in addition, including, in at least one of said secondary main kerfs, at least one region which includes an interference kerf, said interference kerf being of substantially the same width as said secondary main kerf but being laterally-offset from a longitudinally-extending axis of said secondary main kerf, and being in direct communication with said secondary main kerf, said intermediate plate also including a relief kerf, said laterally-offset distance between said interference kerf and said secondary main kerf being substantially equal to the width of said secondary main kerf, the length of said relief kerf being substantially equal to, but slightly longer than, the length of said interference kerf, said relief kerf being disposed alongside said interference kerf, and being spaced a predetermined distance from the closer outer edge of said secondary main kerf wherein each primary main kerf is linear, whereby each corresponding tertiary main kerf is likewise linear, and wherein each corresponding secondary main kerf and each corresponding interference kerf each are likewise linear, and wherein said associated relief kerf is linear;

(c) a lower steel plate which has been laser cut in a series of tertiary main kerfs which is identical to said series of primary main kerfs;

(d) a peripheral steel band encasing peripheral edges of said intermediate plastic plate, said steel band being sandwiched between perimetral edges of said upper plate and said lower plate;

(e) a plurality of steel rules each of which extend downwardly through an associated one of said series of primary main kerfs and each of which extend downwardly through, and are selectively-releasably-secured within an associated one of said series of secondary main kerfs in said intermediate plate and extend into, and repose within, an associated one of said series of tertiary main kerfs in said lower plate; and (f) means rigidly securing said upper steel plate, said intermediate plate of synthetic plastic material and said lower steel plate together in a dimensionally-stable manner, thereby to provide a monolithic unit, said means rigidly securing solid upper plate, said intermediate plate and said lower plate together in a dimensionally-stable manner including a nut and bolt combination passing through aligned apertures in the four corners of each said plates.

19. The steel rule die as claimed in claim 18, including a plurality of set screws which are secured within aligned apertures adjacent to said primary kerf, to said second kerf and to said tertiary kerf to enhance the dimensional stability of said intermediate synthetic plastic plate.

20. The steel rule die as claimed in claim 18, wherein at least one said relief kerf is fitted with an insert of a natural rubber or synthetic rubbery material.

* * * * *